US006201874B1

(12) United States Patent
Croft, III et al.

(10) Patent No.: US 6,201,874 B1
(45) Date of Patent: Mar. 13, 2001

(54) ELECTROSTATIC TRANSDUCER WITH NONPLANAR CONFIGURED DIAPHRAGM

(75) Inventors: James J. Croft, III; Elwood G. Norris, both of Poway, CA (US)

(73) Assignee: American Technology Corporation, San Diego, CA (US)

( * ) Notice: Subject to any disclaimer, the term of this patent is extended or adjusted under 35 U.S.C. 154(b) by 0 days.

(21) Appl. No.: 09/207,314

(22) Filed: Dec. 7, 1998

(51) Int. Cl.[7] ..... H04R 25/00

(52) U.S. Cl. ..... 381/191; 381/174; 381/173; 381/190; 367/170; 367/181

(58) Field of Search ..... 381/113, 116, 381/341, 342, 191, 398, 399, 423, 174, 173, 190; 367/170, 181

(56) References Cited

U.S. PATENT DOCUMENTS

| | | | | |
|---|---|---|---|---|
| 1,747,952 | | 2/1930 | Reisz . | |
| 1,764,008 | * | 6/1930 | Crozier | 381/191 |
| 1,782,278 | | 11/1930 | Vogt . | |
| 1,799,053 | | 3/1931 | Mache . | |
| 1,809,754 | * | 6/1931 | Steedle | 381/191 |
| 1,839,130 | | 12/1931 | Thomas . | |
| 1,844,219 | | 2/1932 | Greaves . | |
| 1,851,240 | | 3/1932 | Crozier . | |
| 1,859,170 | | 5/1932 | Reisz . | |
| 2,864,899 | | 12/1958 | Parker . | |
| 3,859,477 | * | 1/1975 | Skvor | 179/111 R |
| 4,041,446 | * | 8/1977 | Liebermann | 340/17 R |
| 4,284,921 | | 8/1981 | Lemonon et al. . | |

* cited by examiner

*Primary Examiner*—Curtis A. Kuntz
*Assistant Examiner*—Dionne Harvey
(74) *Attorney, Agent, or Firm*—Thorpe, North & Western, L.L.P.

(57) ABSTRACT

An electrostatic transducer having respective first and second stators, each having an interior surface, which are displaced and juxtaposed, and including a flexible diaphragm leaving a conductive layer and being operable as an electrostatic emitter. The diaphragm includes an emitter portion which is interposed between the respective interior surfaces of the first and second stators and is configured as a nonplanar film characterized by a continuous array of peaks and valleys. The emitter portion of the diaphragm is positioned adjacent, but substantially unattached to the respective interior surfaces of the first and second stators. The peaks of the emitter portion of the diaphragm may contact the interior surfaces, or may be displaced therefrom. Also disclosed is a method for generating audio output from an electrostatic transducer utilizing a nonplanar emitter portion of a flexible, film diaphragm.

36 Claims, 5 Drawing Sheets

ELECTROSTATIC TRANSDUCER WITH NONPLANAR CONFIGURED DIAPHRAGM

BACKGROUND OF THE INVENTION

1. Field of the Invention

This invention relates to charged capacitive transducers, and in particular to diaphragm configurations for transducers which are in contact with stator elements of an electrostatic speaker.

2. Prior Art

Although the concept of electrostatic loudspeakers has been in development for about one hundred years, commercial applications were not realized until the late 1940's. Since then, a standard construction for electrostatic loudspeakers has dominated the state of the art. This standard utilizes two conductive, stationary, planar stators positioned such that they are in parallel, coaxial relationship with a specific displacement gap therebetween. A tensioned diaphragm, usually made of metalized polyester, is positioned between the stators in noncontacting, suspended configuration. Two polarities of an AC audio signal are sent from the output of a step-up tansformer to the two respective stators. A high voltage, low current DC bias voltage is concurrently applied to the movable diaphragm for enabling vibration for an audio output.

Despite many advantages of electrostatic speakers, commercial acceptance over dynamic speaker systems has been nominal. Magnetically driven cones and related dynamic speakers have secured over 90% of the audio market, and continue to increase in market share. This is due in part to the high cost of production of quality electrostatic systems, space requirements for obtaining low range frequency response, and difficulty in obtaining structures which are suited for long term stability and dependable operation.

Technical difficulties with prior art electrostatic loudspeakers include balance of diaphragm tension, resonant frequency, bias voltage and diaphragm stability. Such balancing is problematic, because adjustment of one factor often leads to imbalance of another. For example, greater tension is required for stability; however, any increase in tension results in concurrent reduction of low frequency range response. Similarly, lowering the bias voltage increases stability, but at the same time reduces sensitivity. Besides trade-offs in performance, the tensioning of the diaphragm leads to manufacturing difficulties and challenges with maintenance of required tension over extended periods of use. Tensioning requirements of suspending the diaphragm in noncontacting condition between the stators severely limits speaker shape and configuration. Accordingly, prior art electrostatic speakers have traditionally been expense, flat, large in size and generally unattractive.

Another issue with prior art electrostatics is that they are very sensitive to loading and reflections that come from any wall or enclosure which is intimate with the speaker device. The result can be an undesirable increase in resonant frequency, reduced midband output, and poor frequency response. These factors place significant limitations on speaker positioning within a home or commercial application, and raise further concerns with customer satisfaction with the field of electrostatic systems generally.

U.S. Pat. No. 2,872,532 by Buchmann et. al.; U.S. Pat. No. 2,935,575 by Bobb; and U.S. Pat. No. 4,439,642 by Reynard are representative of numerous prior art references which teach the basics of electrostatic speaker design. These references illustrate the conventional tensioned diaphragm suspended over a stator which includes openings or some other form of adaptation for acoustical transparency. Numerous variations of design have been attempted to realize other uses for electrostatic systems. For example, U.S. patent by Schindel et. al. shows modification of the rigid stator to include a roughened surface with peaks and valleys (FIG. 4) to facilitate high frequency response useful for ultrasonic emitters. U.S. Pat. No. 2,855,467 by Curry and U.S. Pat. No. 3,544,733 by Reylek et. al. illustrate flexible dielectric diaphragms in combination with flexible conductive films which provide marginal audio output for specialized applications. Other advances have been pursued by anchoring or attaching the diaphragm along its surface area to avoid the difficulty of broad surface tensioning as discussed above. FIG. 6 of U.S. Pat. No. 1,809,754 by Steedle shows the capture of a diaphragm 16 between opposing stator elements 10 and 11. This construction localizes the vibrating diaphragm area to strips as illustrated in FIG. 3 and develops a nonplanar diaphragm configuration. A similar "strip-like" construction is illustrated in U.S. Pat. No. 1,799,053 by Mache wherein a rigid stator "a" supports a nonplanar diaphragm "b". Hereagain, diaphragm movement appears to be isolated to strips of material captured as shown in FIG. 3.

None of the prior art references have developed a commercially acceptable solution to the difficulty of providing an inexpensive electrostatic speaker that can service the audio industry.

Nevertheless, such applications continue to become more extensive as quality sound systems are being demanded with virtually every sound source from pocket CD players and lap top computers, to surround sound stereo associated with in-home theater applications. Such systems require broad frequency response, maintenance free use, and cost competitive basis to enable competition with the dynamic speaker market.

OBJECTS AND SUMMARY OF THE INVENTION

It is therefore an object of the present invention to provide an electrostatic speaker which is inexpensive to construct, yet supplies broad band, high quality audio output.

It is a further object of this invention to provide an electrostatic speaker which is mechanically superior to prior art electrostatic speaker devices.

It is an object to provide an electrostatic speaker which minimizes the compromise associated with the balance of diaphragm tension, resonant frequency, bias voltage and diaphragm stability.

It is a still further object of this invention to provide an electrostatic speaker which reduces the difficulty of achieving ideal diaphragm tension during the manufacturing process and during extended use.

It is yet another object to provide an electrostatic speaker which is capable of being manufactured in many different shapes.

It is a further object to provide an electrostatic speaker design to reduce sensitivity to loading an reflections that results from acoustic coupling with a wall or enclosure.

Other objects and features of the present invention will be apparent from the following detailed description, taken in combination with the following drawings.

DETAILED DESCRIPTION OF THE PREFERRED EMBODIMENTS

Figure 1:
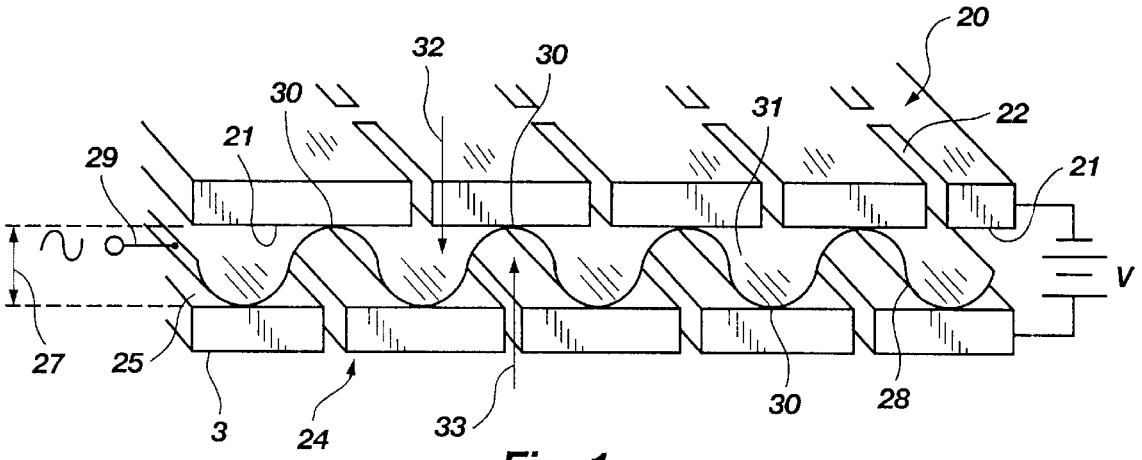
FIG. 1 is a perspective view of one embodiment of the present invention having a generally sinusoidal diaphragm between opposing stators of the electrostatic transducer device.

FIG. 1 shows an electrostatic transducer constructed within the general concepts of this invention. It includes a first rigid stator 20 having an interior surface 21 and adapted with slots or openings 22 for providing acoustic transparency for audio output. Any conductive material typically used for prior art electrostatic transducers may be applied with the present invention, such as metals, doped plastics, and nonconductive substrates having a conductive coating. The stator is configured to provide uniform charge dispersion and a rigid support, consistent with prior art tensioned electrostatic transducers.

A second rigid stator 24 having an interior surface 25 which is juxtaposed to the interior surface of the first stator. The construction of this second stator is similar to the first stator 20, including slots 26 and conductivity properties. A voltage source is coupled to the respective stators in accordance with well know principles. An appropriate separation distance or gap 27 is provided between the respective interior surfaces 21 and 25 for receiving at least one flexible diaphragm 28 as the electrostatic emitter membrane.

The flexible diaphragm 28 is constructed with a conductive layer and is coupled to a signal and bias source 29. A double sided polyester—metal—polyester film may be used to protect arcing between the diaphragm and the stators. Other compositions for emitter films are well known to those skilled in the art. Accordingly, details of diaphragm construction are not set forth beyond the illustrated single member representation 28. FIG. 1 illustrates application of an audio signal to effect vibration of the diaphragm to facilitate audio output.

Figure 8:
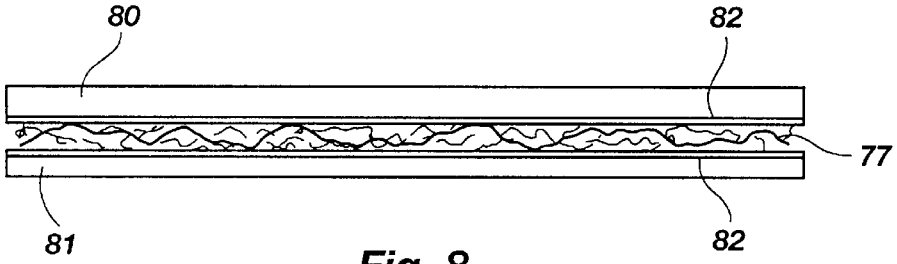
FIG. 8 is a side view of the diaphragm of FIG. 7 disposed between two stators.

One feature of the present invention is the adaptation of the diaphragm with a geometric configuration characterized by a continuous array of peaks 30 and valleys 31 as viewed from each respective side 32 and 33 of the diaphragm. In other words, when viewing the diaphragm from the top side 32, one sees alternating peaks 30 and valleys 31 which substantially define the operating surface of the diaphragm relative to the interior surface 21 of the first stator 20. Similarly, when viewing the diaphragm from the bottom side 33, one sees alternating peaks 30 and valleys 31 which substantially define the operating surface of the diaphragm relative to the interior surface 25 of the second stator 24. As used herein, peaks and valleys is a general reference to a nonplanar diaphragm construction wherein opposing sides of the diaphragm form multiple contact points (peaks) with respective interior surface areas of the stators, separated from adjacent contact points by noncontacting regions (valleys) of the diaphragm displaced from the interior surface areas. As will be noted hereafter, the array of peaks and valleys need not be recurring in accordance with a particular pattern. Indeed, FIG. 8 illustrates a totally random array of peaks and valleys resulting from a diaphragm membrane which has been crumpled into compressed shape, and then released to impart crinkled ridges as the contact points or peaks. Therefore, it is to be understood that any form of flexible, nonplanar film configuration may provide the desired properties of peaks and valleys as set forth in the invention as claimed.

Another important feature of the present invention is that the peaks of each side of the diaphragm are positioned adjacent to interior surfaces of the stators, but are substantially unattached. This is in contrast to prior art diaphragms of nonplanar form which are anchored at points along the diaphragm in strip-like configuration. Whereas prior art emitters were somewhat segmented for vibration along each strip length, the present invention involves a diaphragm which is not attached or so anchored. This is not to say that some attachment may be necessary, such as around the perimeter for positioning the diaphragm between the stators. However, the diaphragm is generally unattached to provide general freedom of movement.

Indeed, some embodiments of the present invention permit the peaks to displace orthogonally with respect the interior surfaces of the stators during operation for enhancement of low end frequency response. Accordingly, the present invention includes the general concept wherein the peaks of each side of the diaphragm are unattached to the respective interior surfaces of the first and second stators except for anchoring points at a periphery of the diaphragm.

Figure 2:
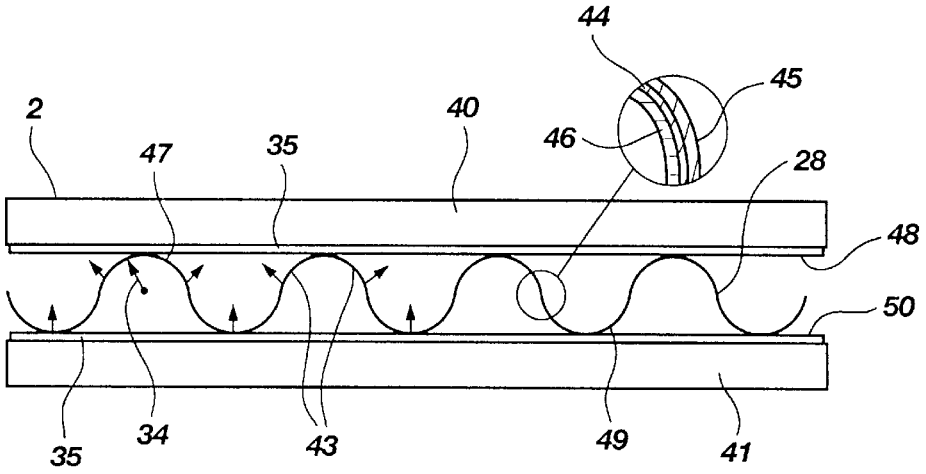
FIG. 2 shows a graphic side view of a second embodiment of the present invention, including a cushion member between the diaphragm and the stators.

FIGS. 1 and 2 illustrate a diaphragm 28 having a generally sinusoidal configuration. This shape has demonstrated a broadband response which generates a surprisingly high quality electrostatic speaker. The sinusoidal curvature may be applied by numerous methods to conventional polyester film (Mylar). Although the film may readily be molded or otherwise preformed, the present inventors have discovered that subjecting the film to heat converts the film to a gentle curvature with a radius 34 of ⅛th to ¼ inch in a consistent recurring manner.

This diaphragm was positioned between two opposing metal grid stators, and cushioned with a thin layer of nonconductive foam 35. The foamed layer provides a soft landing for the peaks 30 as they are pushed and pulled toward the interior surfaces of the stators. Because of the nearness of the oppositely charged surfaces 35 and 21, this region has the highest capacitance and greatest attraction. Accordingly, the use of the cushion prevents slapping of the diaphragm against the otherwise rigid stator, particularly at lower frequencies and may be continuous across the interior surface of at least one of the stators, or may be segmented as shown in 12. Similarly, the cushion layer may be conductive where the diaphragm includes a nonconductive contacting side juxtaposed to the conductive cushion layer.

FIG. 2 illustrates one possible mode of operation of the diaphragm 28 in a push pull system between the stators 40 and 41. As attractive forces increase, the near curved portions 43 which diverge from the stator are pushed or pulled away or nearer to the adjacent stator surface. This creates a rolling action of the diaphragm which generates the resultant sound waves desired. Because the peaks are not attached to the stator structure and isolated in strip-like configuration, the sound waves are more unified across the face of the whole diaphragm. The interposed thin layer of foam 35 also allows gentle movement of the diaphragm in a controlled manner toward the nearby stator, as the foam layer is sequentially compressed and released by the diaphragm. Collectively, these features permit the diaphragm to operate with sufficient freedom to develop excellent low frequency sound.

FIG. 2 also illustrates one embodiment of the diaphragm in which the conductive layer 44 is insulated on each side by opposing layers of dielectric material such as the polyester described above. Specifically, the movable diaphragm 28 comprises opposing first and second nonconductive layers 45 and 46 applied to opposing first and second sides of the conductive layer 44, the peaks 47 of the first layer 45 of the diaphragm are disposed for contact at the interior surface 48 of the first stator 40 in response to changing charge distribution on the first and second stators. Similarly, the peaks 49 of the second side of the diaphragm are disposed in alternating manner with respect to the peaks 47 of the first side for contact at the interior surface 50 of the second stator in response to the changing charge distribution on the first and second stators. With opposing insulated surfaces of this diaphragm, it should be noted that the foam layer 35 may be either conductive or nonconductive. This cushion layer may be selected from numerous materials which provide a soft, resilient landing surface for the diaphragm, such as polyester, cotton, nylon, and conductive forms of these materials. Generally, the cushion layer has a thickness of less than 2 millimeters; however, greater thicknesses may be applied for specific effects.

Figure 3:
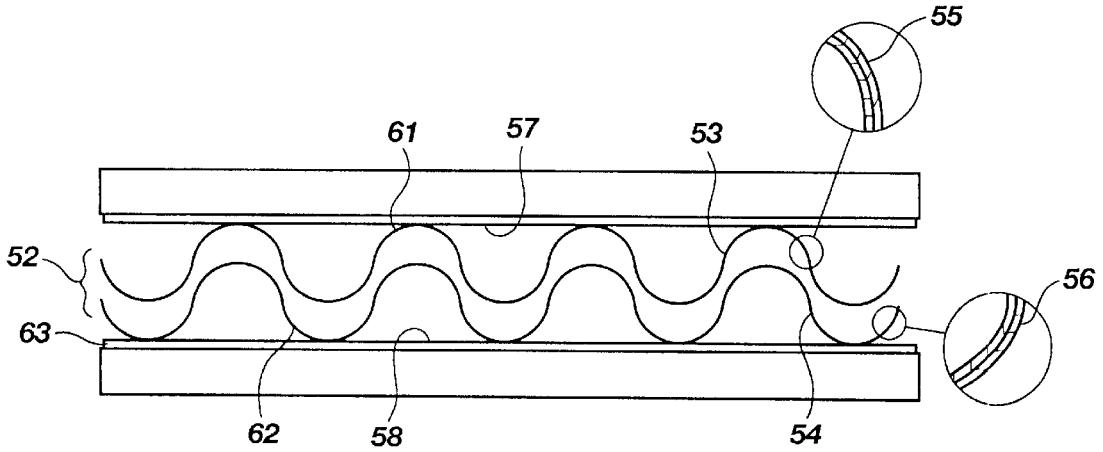
FIG. 3 is a graphic representation of another embodiment of this invention, using a double diaphragm.

FIG. 3 shows an electrostatic transducer wherein the movable diaphragm 52 comprises at least two conductive layers of film 53 and 54 having respective first and second nonconductive layers 55 and 56 applied to opposing first and second sides which are most adjacent to the interior surfaces 57 and 58 of the respective first and second stators 59 and 60. The peaks 61 of the first nonconductive layer of the diaphragm are disposed for contact at the interior surface 57 of the first stator in response to changing charge distribution on the first and second stators, and the peaks 62 of the second nonconductive side of the diaphragm are disposed in alternating manner with respect to the peaks of the first side for contact at the interior surface 58 of the second stator in response to the changing charge distribution on the first and second stators. Here again, the respective first and second stators include some form of openings (not shown) positioned adjacent the respective alternating valleys of the first and second sides of the diaphragm to enable propagation of sound through the stator to a surrounding environment.

The respective interior surfaces of the first and second stators have been modified with the thin cushioning layer 63 of material to provide a soft landing area of contact for the peaks of the respective first and second sides of the diaphragm.

Figure 4:
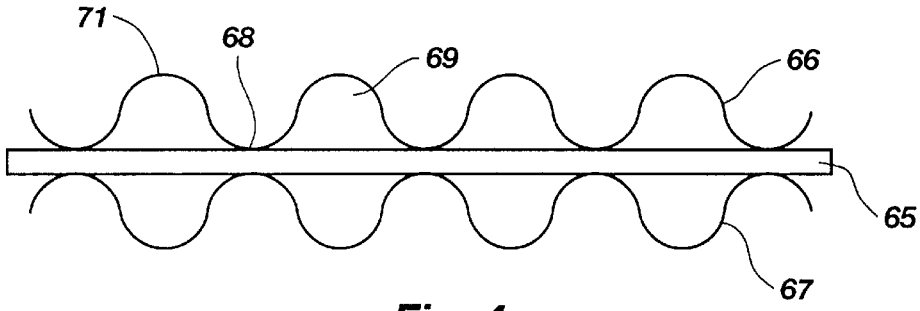
FIG. 4 shows an additional graphic view in cross section of a single stator with opposing diaphragms on both sides of the stator.
Figure 5:
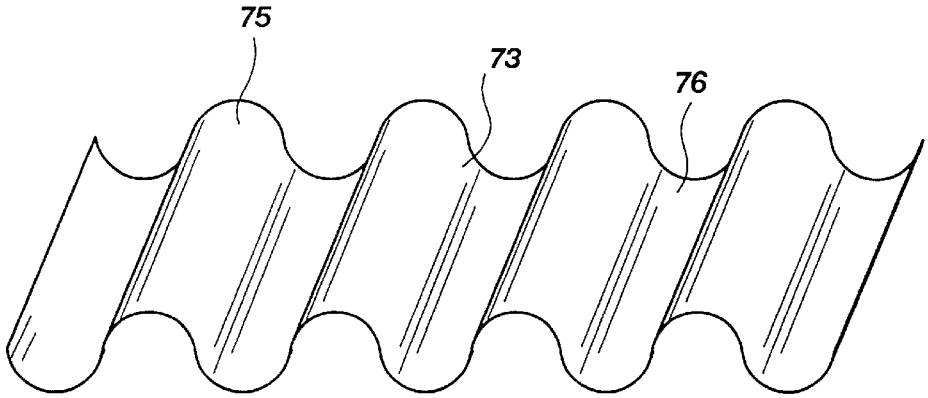
FIG. 5 is a perspective view of the diaphragm illustrated in FIGS. 1 and 2.
Figure 6:
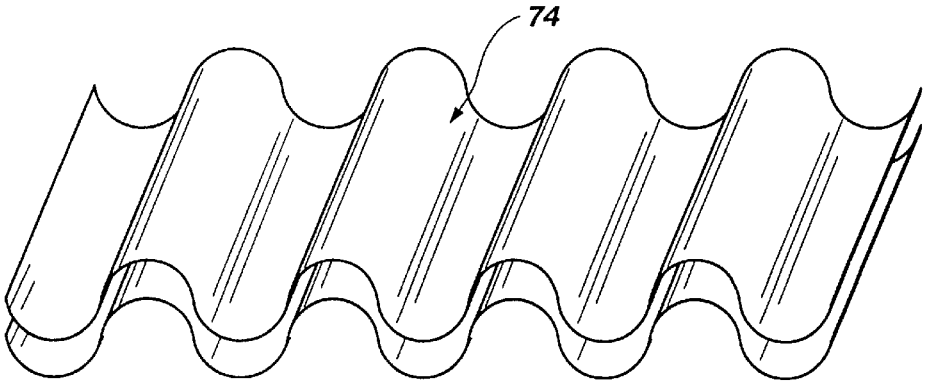
FIG. 6 is a perspective view of the diaphragm illustrated in FIGS. 3.

FIG. 4 illustrates an inverted configuration, wherein a single stator 65 supports opposing diaphragms 66 and 67. The peaks 68 and valleys 69 operate in a similar manner as described above. A housing or enclosure 70 provides a cushioned containment of the peaks 71 which are remote from the stator. Other diaphragm configurations will be apparent to those skilled in the art, including modified sine waves, rectified sine waves, saw tooth configurations, etc. Three dimensional perspective of representative single 73 and double diaphragm 74 systems are illustrated in FIGS. 5 and 6 respectively. These views illustrate the peaks 75 and valleys 76 which form ridges and channels along the length of the diaphragm.

Figure 7:
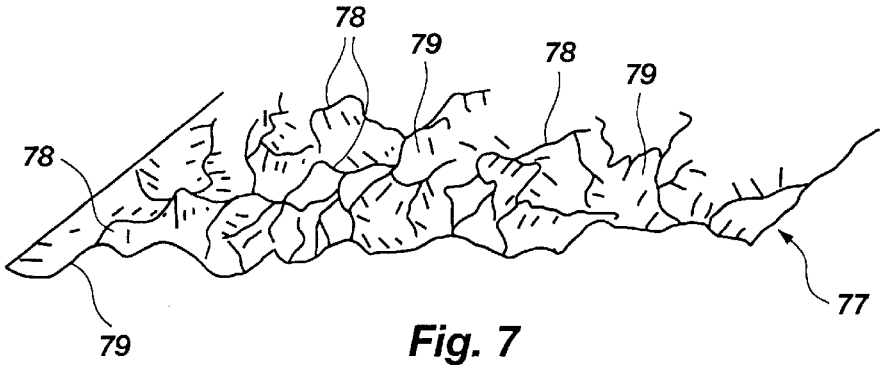
FIG. 7 is a perspective view of the diaphragm depicting a crinkled version.

FIGS. 7 and 8 show a contrasting, random version of peaks and valleys, wherein a sheet of polyester 77 has been compressed into a ball to cause a wrinkling effect on the structure. Upon release, the film expands, but retains the wrinkles in the form of peaks 78 and separating valleys 79. In FIG. 8, this crinkled sheet has been disposed between stators 80 and 81 to realize an operative electrostatic transducer in accordance with the present invention. Here again, a cushion layer 82 is applied at the interior surfaces of the respective stators. This randomized configuration represents an effective form of electrostatic speaker with excellent fidelity.

Figure 9:
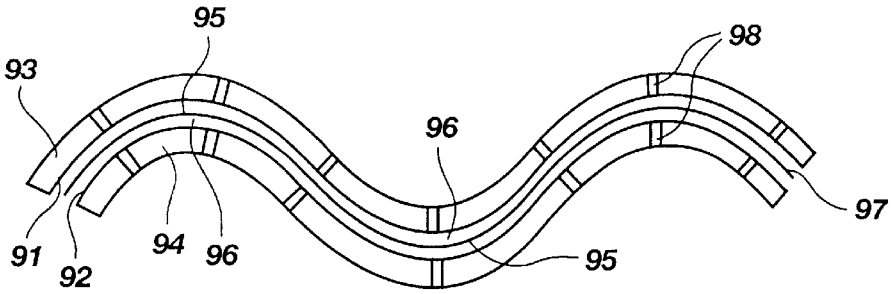
FIG. 9 depicts a graphic representation of a sinusoidal stator configuration matching a sinusoidal diaphragm.
Figure 10:
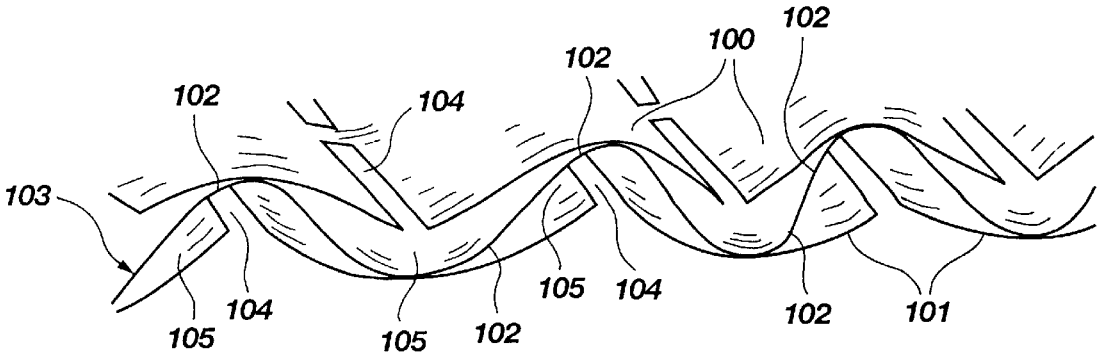
FIG. 10 depicts a graphic representation of a segmented version of the general sinusoidal configuration of FIG. 9.

An additional geometric embodiment of the electrostatic transducer 90 is shown in FIG. 9, wherein the interior surfaces 91 and 92 of the first and second stators 93 and 94 are geometrically configured to generally conform to the desired geometric configuration of the peaks 95 and valleys 96 of the diaphragm 97. This enables close positioning of the respective interior surfaces of the first and second stators adjacent to the diaphragm. Openings 98 are provided in the respective stators to facilitate acoustic transparency. FIG. 10 is a modified version of this close configured design of FIG. 9, wherein the stator members 100 and 101 are contoured and shaped for more proximate location to the peaks 102 of the diaphragm 103. Slots 104 are positioned within the valleys 105, and are therefore in close proximity to drive adjacent portions of the diaphragm 103 in push-pull operation. It will be apparent to those skilled in the art that other geometries can be envisioned which place the stators in close position to the diaphragm to increase the effects of electrostatic field influence therebetween.

Figure 11:
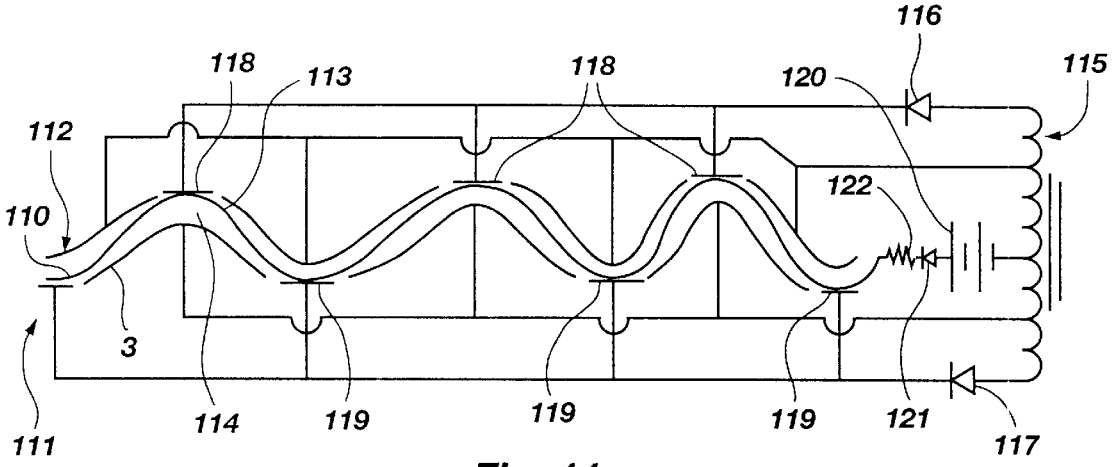
FIG. 11 depicts a graphic representation of a segmented version with modified voltage source on the stator/diaphragm peaks.

Another version of the subject invention which is designed for enhanced efficiency is shown in FIG. 11. It will be noted from the previous two figures that when the stators are in the attraction mode with respect to contacting peaks of the diaphragm, there is little work accomplished in view of the lack of movement at the peaks. Nevertheless, energy is being supplied to the total diaphragm, resulting in wasted energy at the nonmoving peaks. FIG. 11 discloses a modified stator configuration which minimizes such energy loss. Specifically, the diaphragm 110 is illustrated in suspended form between the two stators 111 and 112. The characteristic peaks 113 and valleys 114 are identified. The stators have been segmented in the vicinity of the contacting peaks 113 to isolate the voltage source 115. Diodes 116 and 117 have been interposed in the connecting circuitry to sequentially block voltage signal applied to the stator segments 118 and 119, to thereby allow repulsion forces to be applied to the contacting peaks 113, but nullify attraction forces which serve no purpose. It should also be noted that a center tap transformer 120, diode 121, and resister 122 have been coupled to the diaphragm to provide a coordinated bias charge which cooperates with the stator voltage to generate electrostatic driven vibrations for sound output.

Other variations of the present invention as illustrated in FIGS. 9–11 wherein the diaphragm is configured with a sinusoidal curvature and the interior surfaces of the first and second stators are geometrically configured to generally conform to the sinusoidal curvature of the diaphragm will be apparent to those skilled in the art. These variations include general structures wherein the respective first and second stators are configured respectively with concave and convex geometries in nesting relationship to provide an audio speaker having a convex emitting surface.

Figure 12:
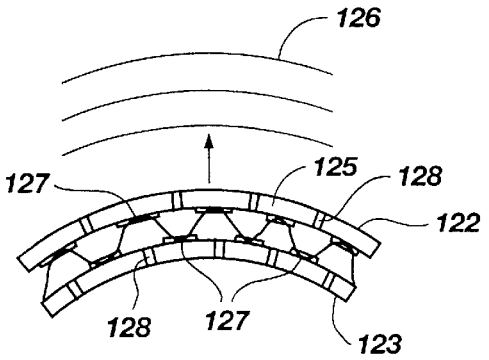
FIG. 12 depicts a graphic representation of a concavo-convex embodiment of the present invention.

FIG. 12 illustrates a version of the present invention wherein the opposing stators 122 and 123 are respectively convex in shape with the same nesting configuration. This design follows the form of FIGS. 1–8, but with the provision that the arc shape provides a convex emitting face 125 to provide a diverging propagation of sound 126. This embodiment also illustrates the use of a segmented format of the cushion layer, wherein the cushion layer is segmented in noncontinuous manner, said segments of the cushion layer being positioned for contact with contiguous peaks extending across the interior surface of at least one of the stators.

This provides an unobstructed passage for sound through the openings 128.

Figure 13:
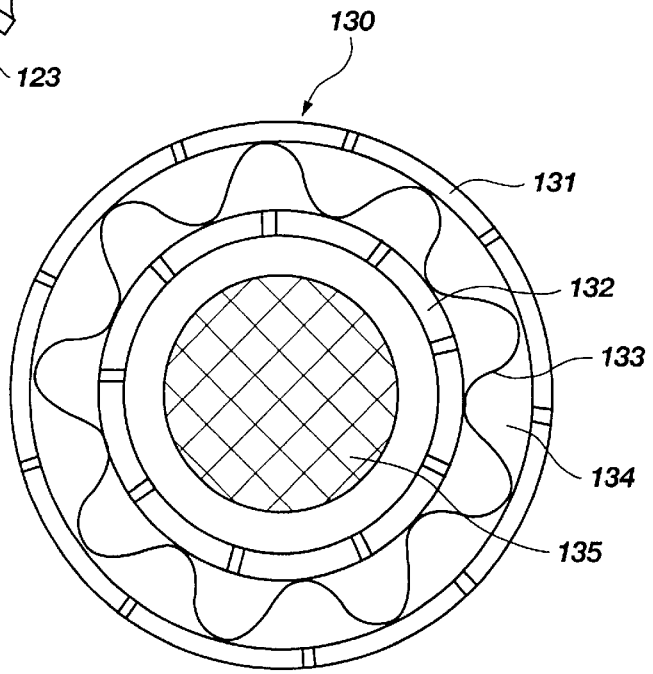
FIG. 13 depicts a graphic representation of concentric cylinders and diaphragm as an electrostatic transducer.
Figure 14:
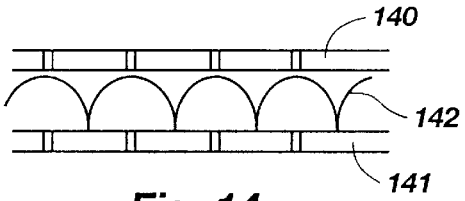
FIGS. 14 and 15 graphically illustrate other diaphragm configurations including a rectified sine wave and saw tooth version.
Figure 15:
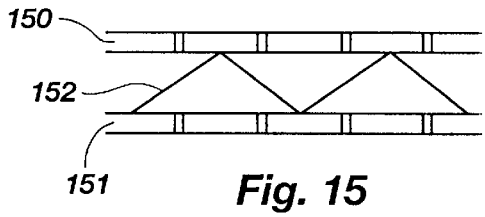

FIG. 13 depicts a cross section of an electrostatic transducer 130 wherein the respective first and second stators 131 and 132 are configured respectively as cylinders with concentric, enclosing geometries to provide an audio speaker having a substantially full surround emitting surface. The diaphragm 133 is suspended within the annular opening 134, being stabilized between the opposing interior surfaces of the stators. Sound is emitted circumferentially, as well vertically, from a central resonant chamber 135. Openings 136 provide acoustic transparency along both radial orientations of propagation. The diaphragm is illustrated in a preferred form of general sinusoidal shape; however, other diaphragm configurations are possible such as the rectified sinusoidal shape of FIG. 14 and the modified sawtooth form of FIG. 15. In each case, the diaphragm 142 and 152 is positioned between the stators 140, 141 and 150, 151.

Figure 16A:
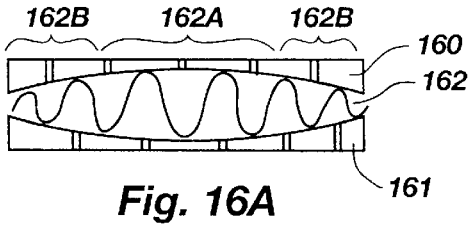
FIGS. 16A and 16B depict graphic representations of a stator/diaphragm combinations having a diaphragm configured for selected resonance bandwidths.
Figure 16B:
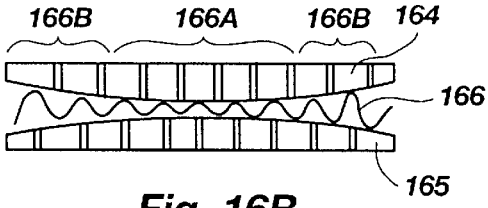
Figure 17:
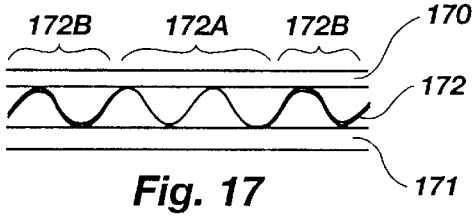
FIG. 17 depicts a graphic representation of a transducer in which the diaphragm is modified in structural mass or stiffness for favored bandwidth response.

FIGS. 16–17 show variations in the diaphragm useful for developing different resonant responses within the electrostatic emitter. For example, FIG. 16A represents a graphic illustration of stators 160 and 161 having opposing concave interior surfaces. A sinusoidal diaphragm 162 is disposed between the concave surfaces with increasing height of peaks to extend to at least near contact with the stators. The larger wave forms 162A favor lower resonant frequencies, while the shorter peaks 162B operate at the higher resonant frequencies.

Conversely, the embodiment of FIG. 16B depicts opposing convex stators 164 and 165, with an intermediate diaphragm 166 having a central section 166A favoring higher frequencies, and lateral sections 166B configured for lower frequencies. These embodiments generally represent the configuring of the diaphragm for different resonant frequencies based on wave form height and shape.

FIG. 17 illustrates the modification of the diaphragm 172 within the respective stators 170 and 171, by changing mass, stiffness, or similar physical properties. In this example, the sides 172B of the diaphragm have greater stiffness or thicker material to facilitate a higher resonant frequency. The central portion of the diaphragm is thinned out, to raise the resonant frequency for higher ranges. Other forms of variation of the stators and diaphragm will be apparent in view of the principles illustrated.

Figure 18A:
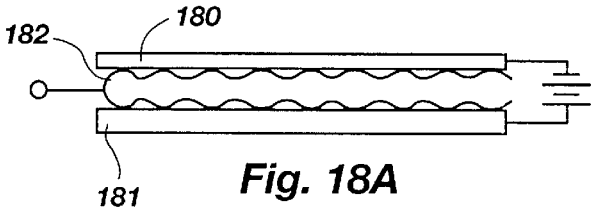
FIGS. 18A, B and C graphically show transducers with varied orientations of stator relationship for double sided performance.
Figure 18B:
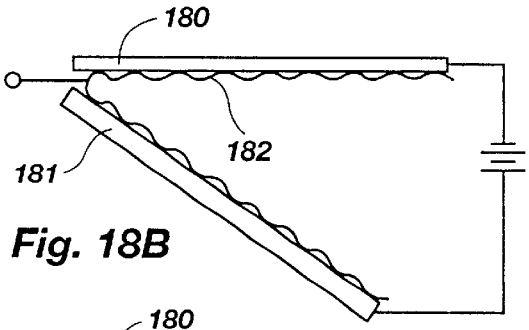
Figure 18C:
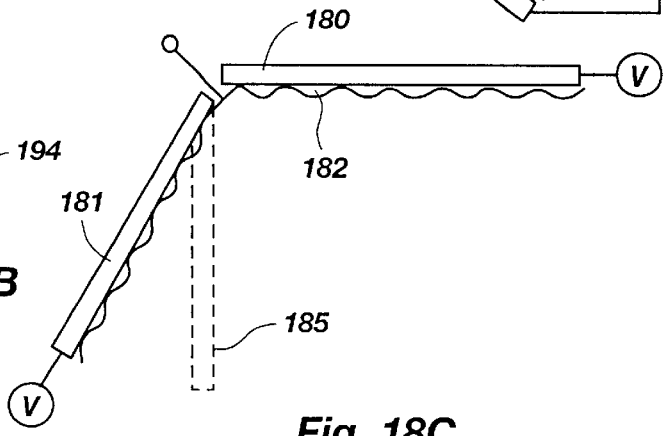

Finally, FIGS. 18 and 19 depict variations in an unusual phenomenon observed with respect to the suspended diaphragm structure developed in the present invention. FIG. 18A shows a stator configuration 180 and 181 corresponding to FIG. 3, but with a single emitter film 182 being folded to provide the two sheets of the diaphragm. In this embodiment, the application of a bias voltage to the diaphragm 182 drives the corresponding diaphragm half sheets apart and toward the stators. This helps prevent slapping between the two sheets to minimize distortion. FIGS. 18B and 18C illustrate the angular separation of the stators to acute and obtuse relationship, while maintaining continuity between the respective two sheets of diaphragm.

It is recognized that a push-pull operation would be natural for the embodiment of FIG. 18A. As the stators are separated to an acute angle, one would expect the transducer to significantly lose the dynamics of a doubled sided audio output (as in FIG. 18A); however, surprisingly this doubled sided response continues. Even more unexpectedly, the double sided response remains with the angular rotation of the stators to an obtuse orientation as shown in FIG. 18C. Clearly, the expected response of FIG. 18C would favor a singled sided transducer. Nevertheless, acoustic measurements confirm this surprising phenomenon.

In general terms, it has been observed that when the respective first and second stators are in nonparallel relationship, with the diaphragm extending with one surface of peaks and valleys adjacent the interior surface of the first stator, and a second surface of peaks and valleys adjacent the interior surface of the second stator, a doubled sided output is maintained. More specifically, when the respective first and second stators form an angular relationship wherein the interior surfaces of the first and second stators are at an acute angle, the audio output of the transducer corresponds more closely to a push-pull system than a single sided system. This is also true when the first and second stators are at an approximate right angle and even when the relationship of the first and second stators is at an obtuse angle.

Figure 19A:
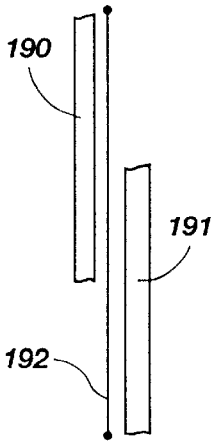
FIGS. 19A, and B graphically show transducers with off-centered orientations of stator relationship for double sided performance.
Figure 19B:
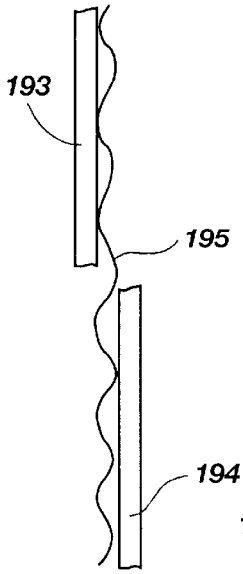

An even more unusual phenomenon was discovered with respect to stator configurations as shown in FIGS. 19A and 19B. In this case, the second stator 191 is displaced off center of alignment with the first stator 192, with the diaphragm extending along and between the respective interior surfaces of the first and second stators for a length such that a first side of the diaphragm covers the interior surface of the first stator and an opposing second side of the diaphragm covers the interior surface of the second stator. In other words, the total surface area of one side of the diaphragm is greater than the interior surface area of either of the first or second stators. In this situation, the first side of the diaphragm is nonconductive with respect to the first stator and the second side of the diaphragm is nonconductive with respect to the second stator. Even in this configuration, the audio output of the transducer corresponds more closely to a push-pull system than a single sided system. This operates for the flat, tensioned diaphragm of FIG. 19A, as well as for the curved diaphragm of FIG. 19B.

It will be apparent to those skilled in the art that numerous variations can be applied with respect to the numerous inventive concepts set forth above. For example, the present invention can also be viewed as a method for generating audio output from an electrostatic transducer, comprising the steps of a) selecting a first rigid stator having an interior surface; b) selecting a second rigid stator having an interior surface; c) configuring at least one flexible, electrostatic diaphragm as a nonplanar film characterized by a continuous array of peaks and valleys as viewed from each respective side of the diaphragm; d) positioning the at least one flexible diaphragm between the respective interior surfaces of the first and second stators with said peaks of each side of the diaphragm being positioned adjacent but substantially unattached to the respective interior surfaces of the first and second stators to enable the peaks to displace orthogonally with respect the interior surfaces of the stators during operation; and e) applying voltages to the respective first and second stators and diaphragm to drive the diaphragm with an applied audio signal as a speaker device.

We claim:

1. An electrostatic transducer, comprising:

a first rigid stator having an interior surface;

a second rigid stator having an interior surface displaced and juxtaposed from the interior surface of the first stator; and at least one flexible diaphragm having a conductive layer and having an emitter portion operable as an electrostatic emitter, said emitter portion being interposed between the respective interior surfaces of the first and second stators, said diaphragm being configured as a nonplanar film characterized by a continuous array of peaks and valleys as viewed from each respective side of the diaphragm, said emitter portion of the diaphragm being positioned adjacent but substantially unattached to the respective interior surfaces of the first and second stators; and means for applying voltages to the respective first and second stators and diaphragm to drive the diaphragm with an applied audio signal as a speaker device.

2. An electrostatic transducer as defined in claim 1, wherein the continuous array of peaks and valleys in the nonplanar film is represented in cross-section by a generally sinusoidal shape with alternating peaks and valleys of an adjacent side of the diaphragm with respect to one of the interior surfaces of the first and second stators.

3. An electrostatic transducer as defined in claim 2, wherein the movable diaphragm comprises opposing first and second nonconductive layers applied to opposing first and second sides of the conductive layer, the peaks of the first layer of the diaphragm being disposed for contact at the interior surface of the first stator in response to changing charge distribution on the first and second stators;

the peaks of the second side of the diaphragm being disposed in alternating manner with respect to the peaks of the first side for contact at the interior surface of the second stator in response to the changing charge distribution on the first and second stators;

the respective first and second stators including openings positioned adjacent the respective alternating valleys of the first and second sides of the diaphragm to enable propagation of sound through the stator to a surrounding environment.

4. An electrostatic transducer as defined in claim 3, wherein the respective interior surfaces of the first and second stators include a thin cushion layer of material to provide a soft landing area of contact for the peaks of the respective first and second sides of the diaphragm.

5. An electrostatic transducer as defined in claim 4, wherein the cushion layer is selected from the group of materials consisting of polyester, cotton, polyurethane, nylon, rayon, silk, and conductive materials of polyester, cotton, polyurethane, nylon, rayon, and silk.

6. An electrostatic transducer as defined in claim 4, wherein the cushion layer is nonconductive and has a thickness of less than 2 millimeters nonconductive.

7. An electrostatic transducer as defined in claim 2, wherein the movable diaphragm comprises at least two conductive layers of film, at least two of the conductive layer of film having respective first and second nonconductive layers applied to opposing first and second sides which are most adjacent to the interior surfaces of the respective first and second stators, the peaks of the first nonconductive layer of the diaphragm being disposed for contact at the interior surface of the first stator in response to changing charge distribution on the first and second stators;

the peaks of the second nonconductive side of the diaphragm being disposed in alternating manner with respect to the peaks of the first side for contact at the interior surface of the second stator in response to the changing charge distribution on the first and second stators;

the respective first and second stators including openings positioned adjacent the respective alternating valleys of the first and second sides of the diaphragm to enable propagation of sound through the stator to a surrounding environment.

8. An electrostatic transducer as defined in claim 7, wherein the respective interior surfaces of the first and second stators include a thin cushioning layer of material to provide a soft landing area of contact for the peaks of the respective first and second sides of the diaphragm.

9. An electrostatic transducer as defined in claim 4, wherein the cushion layer is continuous across the interior surface of at least one of the stators.

10. An electrostatic transducer as defined in claim 4, wherein the cushion layer is segmented in noncontinuous manner, said segments of the cushion layer being positioned for contact with contiguous peaks extending across the interior surface of at least one off the stators.

11. An electrostatic transducer as defined in claim 4, wherein the cushion layer is conductive, said diaphragm having a nonconductive contacting side juxtaposed to the conductive cushion layer.

12. An electrostatic transducer as defined in claim 1, wherein the interior surfaces of the first and second stators are geometrically configured to generally conform to the general geometric configuration of the peaks and valleys of the diaphragm to enable close positioning of the respective interior surfaces of the first and second stators adjacent to the diaphragm.

13. An electrostatic transducer as defined in claim 12, wherein the interior surfaces of the first and second stators are segmented as separate surface areas which are geometrically configured to generally conform to individual geometric configurations of adjacent peaks of the diaphragm to enable close positioning of the respective segmented interior surfaces of the first and second stators adjacent to the diaphragm.

14. An electrostatic transducer as defined in claim 13, wherein the segmented surface areas are geometrically configured as concave surfaces to generally conform to individual sinusoidal convex surfaces of adjacent peaks of the diaphragm to enable close positioning of the respective segmented interior surfaces of the first and second stators adjacent to the diaphragm.

15. An electrostatic transducer as defined in claim 13, wherein the segmented surface areas are geometrically configured as convex surfaces to generally conform to individual sinusoidal concave surfaces of adjacent valleys of the diaphragm to enable close positioning of the respective segmented interior surfaces of the first and second stators adjacent to the diaphragm.

16. An electrostatic transducer as defined in claim 12, wherein the interior surfaces of the first and second stators are segmented as separate surface areas which are geometrically configured to generally conform to individual geometric configurations of adjacent valleys of the diaphragm to enable close positioning of the respective segmented interior surfaces of the first and second stators adjacent to the diaphragm.

17. An electrostatic transducer as defined in claim 13, wherein the segmented surface areas of the respective first and second stators include alternating (i) surface areas adjacent a diaphragm valley and (ii) surface areas adjacent a diaphragm peak, said respective surface areas adjacent the diaphragm peaks being separately powered with voltage as compared with voltage applied to surface areas adjacent the diaphragm valleys.

18. An electrostatic transducer as defined in claim 17, further comprising voltage control circuitry coupled to the respective stators wherein (i) a zero voltage is applied to the surface areas adjacent to the diaphragm peaks when (ii) an attracting voltage is applied to surface areas adjacent diaphragm valleys to minimize attractive forces at contacting peaks with the interior surface area of the respective stators, while maintaining strong attractive forces with respect to diaphragm valleys.

19. An electrostatic transducer as defined in claim 1, wherein the diaphragm is configured with a sinusoidal curvature and the interior surfaces of the first and second stators are geometrically configured to generally conform to the sinusoidal curvature of the diaphragm.

20. An electrostatic transducer as defined in claim 1, wherein the diaphragm is configured with a saw tooth configuration and the interior surfaces of the first and second stators are geometrically configured to generally conform to the configuration of the diaphragm.

21. An electrostatic transducer as defined in claim 1, wherein the diaphragm is configured with a rectified sine wave curvature and the interior surfaces of the first and second stators are geometrically configured to generally conform to the curvature of the diaphragm.

22. An electrostatic transducer as defined in claim 1, wherein the diaphragm interposed between the first and second stators is generally unattached to either of the first or second stators except at peripheral points of attachment, enabling the diaphragm to respond to driving forces of the stators as a single speaker membrane with enhanced low frequency response.

23. An electrostatic transducer as defined in claim 1, wherein the peaks of each side of the diaphragm are unattached to the respective interior surfaces of the first and second stators except for anchoring points at a periphery of the diaphragm.

24. An electrostatic transducer as defined in claim 1, wherein the respective first and second stators are configured respectively with concave and convex geometries in nesting relationship to provide an audio speaker having a convex emitting surface.

25. An electrostatic transducer as defined in claim 1, wherein the respective first and second stators are configured respectively with concentric, enclosing geometries to provide an audio speaker having a substantially full surround emitting surface.

26. An electrostatic transducer as defined in claim 25, wherein the respective first and second stators are configured with cylindrical geometries.

27. An electrostatic transducer as defined in claim 1, wherein the respective first and second stators are in non-parallel relati onship, said diaphragm extending with one surface of peaks and valleys adjacent the interior surface of the first stator, and a second surface of peaks and valleys adjacent the interior surface of the second stator.

28. An electrostatic transducer as defined in claim 27, wherein the respective first and second stators form an angular relationship wherein the interior surfaces of the first and second stators are at an acute angle and wherein the audio output of the transducer corresponds more closely to a push-pull system than a single sided system.

29. An electrostatic transducer as defined in claim 27, wherein the respective first and second stators form an angular relationship wherein the interior surfaces of the first and second stators are at an approximate right angle and wherein the audio output of the transducer corresponds more closely to a push-pull system than a single sided system.

30. An electrostatic transducer as defined in claim 27, wherein the respective first and second stators form an angular relationship wherein the interior surfaces of the first and second stators are at an oblique angle, and wherein the audio output of the transducer corresponds more closely to a push-pull system than a single sided system.

31. An electrostatic transducer as defined in claim 1, wherein the second stator is displaced off center of alignment with the first stator, said diaphragm extending along and between the respective interior surfaces of the first and second stators for a length such that a first side of the diaphragm covers the interior surface of the first stator and an opposing second side of the diaphragm covers the interior surface of the second stator, the total surface area of one side of the diaphragm being greater than the interior surface area of either of the first or second stators, said first side of the diaphragm being nonconductive with respect to the first stator and the second side of the diaphragm being nonconductive with respect to the second stator, and wherein the audio output of the transducer corresponds more closely to a push-pull system than a single sided system.

32. An electrostatic transducer as defined in claim 1, wherein the continuous array of peaks and valleys as viewed from each respective side of the diaphragm are configured to vary resonance response of the diaphragm across the interior surfaces of the stators.

33. An electrostatic transducer as defined in claim 32, wherein a portion of the diaphragm is configured with peaks and valleys of relative greater dimension for enhancement of low frequency resonance, compared with peaks and valleys of other portions of the diaphragm which are of lesser dimension for enhancement of higher resonant frequencies.

34. An electrostatic transducer as defined in claim 33, wherein the diaphragm is configured with peaks and valleys of relative greater thickness for enhancement of low frequency resonance, compared with peaks and valleys of other portions of the diaphragm which are of lesser thickness for enhancement of higher resonant frequencies.

35. An electrostatic transducer, comprising:

a first rigid stator having an interior surface;

a second rigid stator having an interior surface displaced and juxtaposed from the interior surface of the first stator; and at least one flexible diaphragm having a conductive layer and being operable as an electrostatic emitter, of said diaphragm having an emitter portion interposed between the respective interior surfaces of the first and second stators and including a nonplanar surface configuration comprising an array of peaks and valleys on opposing sides of the diaphragm forming multiple contact points of the diaphragm with respective interior surface areas of the stators, said contact points being separated from adjacent contact points by noncontacting regions of the diaphragm displaced from the interior surface areas;

said emitter portion being substantially unattached to the respective stators except at a periphery for positioning the diaphragm in a stable location between the stators.

36. A method for generating audio output from an electrostatic transducer, comprising the steps of:

a) selecting a first rigid stator having an interior surface;

b) selecting a second rigid stator having an interior surface;

c) configuring at least one flexible, electrostatic diaphragm as a nonplanar film having an emitter portion characterized by a continuous array of peaks and valleys as viewed from each respective side of the diaphragm, d) positioning the emitter portion between the respective interior surfaces of the first and second stators with said peaks of each side of the emitter portion being positioned adjacent but substantially unattached to the respective interior surfaces of the first and second stators to enable the peaks to displace orthogonally with respect the interior surfaces of the stators during operation; and e) applying voltages to the respective first and second stators and diaphragm to drive the diaphragm with an applied audio signal as a speaker device.

* * * * *